US006572289B2

(12) United States Patent
Lo et al.

(10) Patent No.: US 6,572,289 B2
(45) **Date of Patent: *Jun. 3, 2003**

(54) PUSHBUTTON STRUCTURE OF KEYBOARD

(75) Inventors: Chih Lung Lo, Taipei (TW); Yong Te Tsao, Taipei (TW); Ching-Chiang Yu, Keelung (TW)

(73) Assignee: Behavior Tech Computer Corporation, Taipei (TW)

( * ) Notice: Subject to any disclaimer, the term of this patent is extended or adjusted under 35 U.S.C. 154(b) by 30 days.

This patent is subject to a terminal disclaimer.

(21) Appl. No.: 09/892,494

(22) Filed: Jun. 28, 2001

(65) Prior Publication Data

US 2003/0002904 A1 Jan. 2, 2003

(51) Int. Cl.[7] ..... B41J 5/12
(52) U.S. Cl. ..... 400/491.3; 400/491.2
(58) Field of Search ..... 400/472, 473, 400/477, 490, 491.2, 491.3; 200/344, 345; 361/680

(56) References Cited

U.S. PATENT DOCUMENTS 4,032,729 A * 6/1977 Koistinen ..... 400/491.3
4,582,967 A * 4/1986 Brumit et al. ..... 200/5
6,375,372 B1 * 4/2002 Tsau ..... 400/490

* cited by examiner

*Primary Examiner*—Anthony H. Nguyen
(74) *Attorney, Agent, or Firm*—Rosenberg, Klein & Lee

(57) ABSTRACT

A pushbutton of a keyboard includes a cap supported on a base board by a linkage comprising first and second links pivoted together whereby the cap is movable from a released to a depressed positions when depressed. Each link has upper and lower pivots respectively connected to the cap and the base board. The links have two side bars connected between the upper and lower pivots thereof. Two spring arms extend from the base board having free ends forming L-shaped offset sections receivingly engaging L-shaped recesses defined in corresponding side bars for biasing the cap toward the released position. The spring arms deform when the cap is depressed. When the spring arms are deformed to an extent, the offset sections are abruptly driven toward and impact a contact surface of the recesses, generating a sound of impact and a pulse-like reaction caused by the impact. The deformation of the spring arms helps returning the cap back to the released position when the depression is released.

1 Claim, 4 Drawing Sheets

PUSHBUTTON STRUCTURE OF KEYBOARD

FIELD OF THE INVENTION

The present invention generally relates to a keyboard, such as a computer keyboard, and in particular to a pushbutton structure of a keyboard which generates a pulse-like reaction when it is depressed for indicating the depression thereof.

BACKGROUND OF THE INVENTION

A computer keyboard includes a plurality of pushbuttons each comprising a cap accessible and depressible by a user. A conventional design of the pushbutton comprises a post, which may be hollow, extending from the cap. The post is partially received and is axially movable within a guiding bore. To ensure proper movement of the cap, the post must have a size large enough to reduce the risk of being jammed in the guiding bore. This, however, is contrary to the current trend of miniaturization in the electronic and computer industries.

Pushbuttons having caps supported by a pair of links pivotally connected to each other in a cross form are also known. This structure effectively reduces the space required by a pushbutton. A rubber member is positioned under the cap. The depression of the cap collapses the rubber member. The resiliency of the rubber member restores the cap back to its original un-depressed position. Such a restoration force provided by the rubber member, however, is generally not sufficient to effectively return the cap back to the un-depressed position.

Furthermore, the rubber member only offers a very limited reaction during the depression of the pushbutton. This may sometimes be ignored by the user when the user is depressing the pushbutton and thus making no clear indication of the depression of the pushbutton to the user.

It is thus desirable to provide a pushbutton structure which overcomes the above problems.

SUMMARY OF THE INVENTION

Accordingly, an object of the present invention is to provide a pushbutton structure which generates a pulse-like reaction during depression of the pushbutton for providing a clear indication of the depression of the pushbutton.

Another object of the present invention is to provide a pushbutton structure having a strong restoring force for returning the pushbutton from a depressed position to a released position.

To achieve the above objects, in accordance with the present invention, there is provided a pushbutton structure of a keyboard comprising a cap supported on a base board by a linkage comprising first and second links pivoted together whereby the cap is movable from a released to a depressed positions when depressed. Each link has upper and lower pivots respectively connected to the cap and the base board. The links have two side bars connected between the upper and lower pivots thereof Two spring arms extend from the base board having free ends forming L-shaped offset sections receivingly engaging L-shaped recesses defined in corresponding side bars for biasing the cap toward the released position. The spring arms deform when the cap is depressed. When the spring arms are deformed to an extent, the offset sections are abruptly driven toward and impact a contact surface of the recesses, generating a sound of impact and a pulse-like reaction caused by the impact. The deformation of the spring arms helps returning the cap back to the released position when the depression is released.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
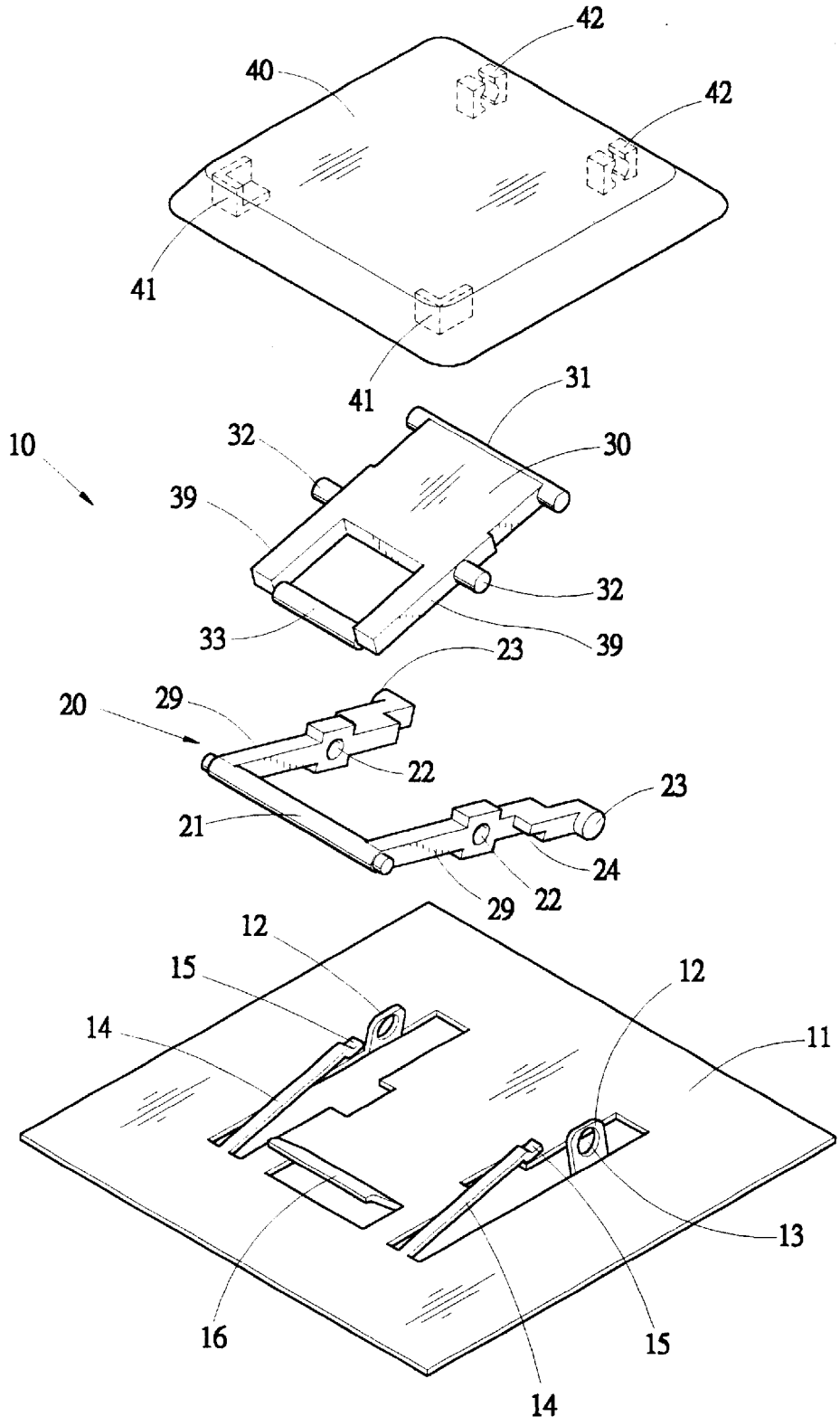
FIG. 1 is an exploded view of a pushbutton constructed in accordance with the present invention.
Figure 2:
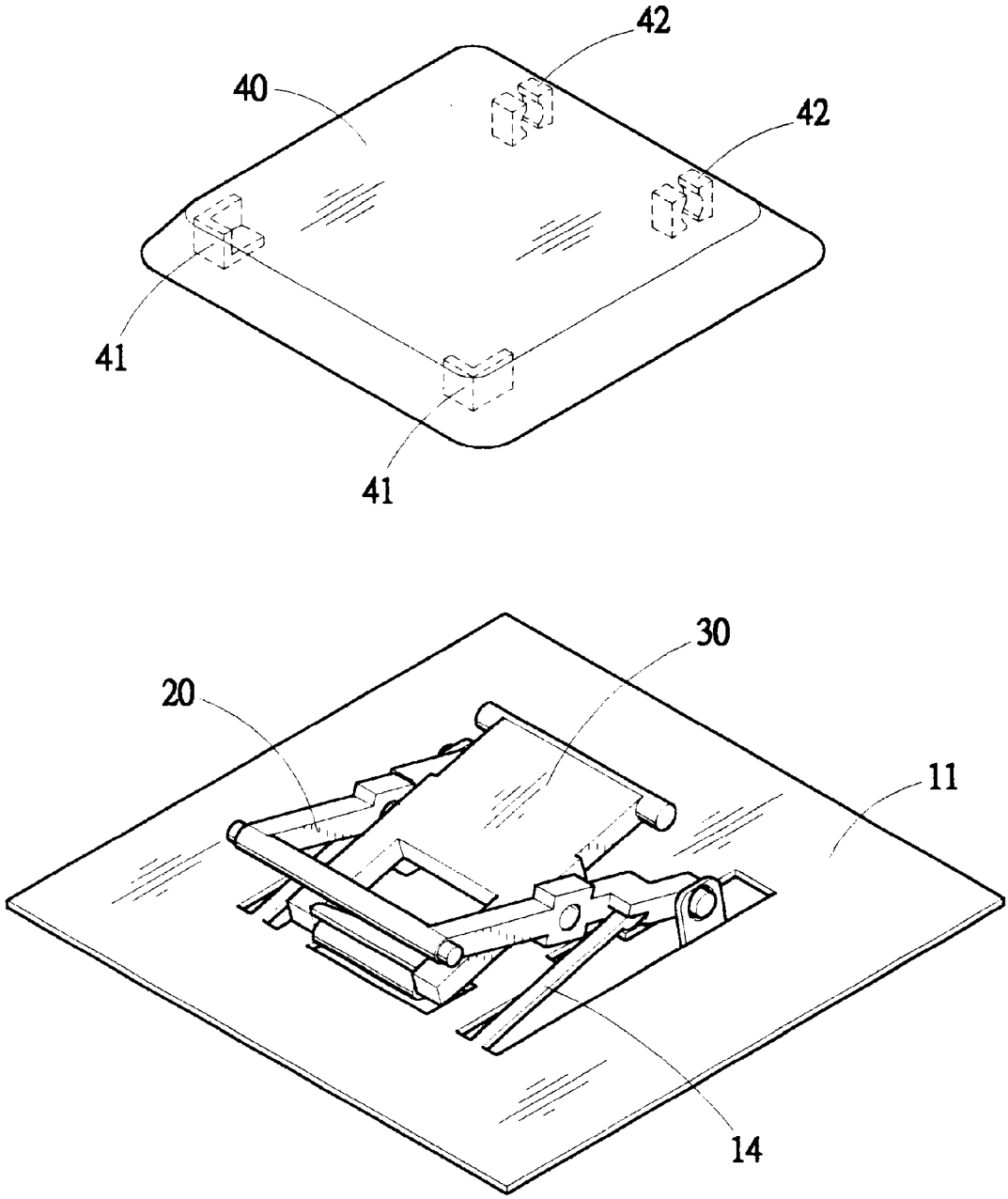
FIG. 2 is perspective view of the pushbutton of the present invention with a cap detached therefrom.

With reference to the drawings and in particular to FIGS. 1 and 2, a pushbutton constructed in accordance with the present invention, generally designated with reference numeral 10, is shown. The pushbutton 10 comprises a linkage (not labeled) consisting of first and second links 20, 30 supporting a cap 40 on a base board 11.

The base board 11 forms a pair of spaced and substantially parallel tabs 12 perpendicularly extending from the base board 11. The tabs 12 define aligned holes 13 for rotatably retaining pivot pins 23 of the first link 20 (FIG. 2). The base board 11 also forms a pair of spaced spring arms 14 each having a free end comprising an offset section 15 forming an L-shape for engaging a corresponding recess 24 defined in the first link 20. A tab 16 is formed on the base board 11 forming a slot for rotatably receiving and retaining a pivot pin 33 of the second link 30.

As shown in FIG. 1, the first link 20 comprises a U-shaped member (not labeled) comprising a first pivot pin 21 and two first side bars 29 extending from opposite ends of the first pivot pin 21. The first pivot pin 21 is rotatably received and retained in first pivot retaining members 41 formed on an underside (not labeled) of the cap 40. In the embodiment illustrated, each first pivot retaining member 41 defines a cavity (not labeled) for receiving a corresponding end of the first pivot pin 21. The first side bars 29 define aligned holes 22. Preferably the holes 22 are formed on substantially centers of the first side bars 29 of the first link 20 as shown in the drawings. Free ends of the first side bars 29 form axially aligned second pivot pins 23 rotataby received and retained in the holes 13 of the tabs 12 of the base board 11.

Each first side bar 29 has a lateral protruding portion (not labeled) defining a recess 24 forming an L-shaped configuration having a contact surface 25. The offset section 15 of the corresponding spring arm 14 of the base board 11 is movably received and engaged by the recess 24 for biasing and/or returning the linkage toward a released position.

The second link 30 comprises a rectangular frame (not labeled) having a third pivot pin 31 and a fourth pivot pin 33 and two second side bars 39 connected between the third and fourth pivot pins 31, 33. Opposite free ends of the third pivot pin 31 are rotatably received and retained in second pivot retaining means 42 formed on the underside of the cap 40. In the embodiment illustrated, the pivot retaining means 42 comprises two spaced resilient projections (not labeled) defining a space therebetween for accommodating each free end of the third pivot pin 31. The fourth pivot pin 33 is rotatably received and retained in the slot formed by the tab 16 of the base board 11. Two axially aligned fifth pins 32 transversely extend, in opposite directions, from the second side bars 39 for being rotatably received and retained in the holes 22 whereby the first and second links 20, 30 are pivotally connected to each other, forming a cross configuration. Due to the pivotal connection between the links 20, 30, the links 20, 30 are allowed to move from the released position (FIGS. 3 and 3A), wherein the links 20, 30 are resiliently supported by the spring arms 14 of the base board 11, to a depressed position as shown in FIGS. 4 and 4A when the pushbutton 10 is depressed.

To assemble, the second link 30 has a width substantially equal to or smaller than a distance between the first side bars 29 of the first link 20 whereby the second link 30 may be accommodated between the first side bars 29 of the first link 20. The fifth pins 32 of the second link 30 are rotatably received in the hole 22 of the first link 20 forming the pivotal connection between the links 20, 30. The first pivot pin 21 of the first link 20 is positioned into the first pivot retaining members 41 of the cap 40. The second pivot pins 23 of the first link 20 are fit into holes 13 of the base board 11. The fourth pivot pin 33 of the second link 30 is placed into the slot 16 formed on the base board 11 and the ends of the third pivot pin 31 are fit into the second pivot retaining means 42 of the cap 40. This mounts both the linkage (links 20 and 30) and the cap 40 to the base board 11. The offset sections 15 of the spring arms 14 of the base board 11 receivingly engage the recesses 24 defined in the first side bars 29 of the first link 20 thereby resiliently supporting the linkage and the cap 40 in the released position (FIG. 3).

When the pushbutton is actuated by depressing the cap 40, the links 20, 30 collapse toward the base board 11 against the spring arms 14, allowing the cap 40 to move toward the base board 11. The movement of the cap 40 causes an electrical contact to change from an OFF condition to an ON condition as is similar to the conventional pushbuttons. No further detail of the contact will be given herein for it is known.

During the depression of the cap 40, the spring arms 14 are deformed (deflected) and spring energy is stored therein whereby when the pushbutton 10 is released, the stored energy drives the spring arms 14 back to their un-deformed condition thereby moving the cap 40 back to the released position when the depression of the pushbutton is released.

Figure 3A:
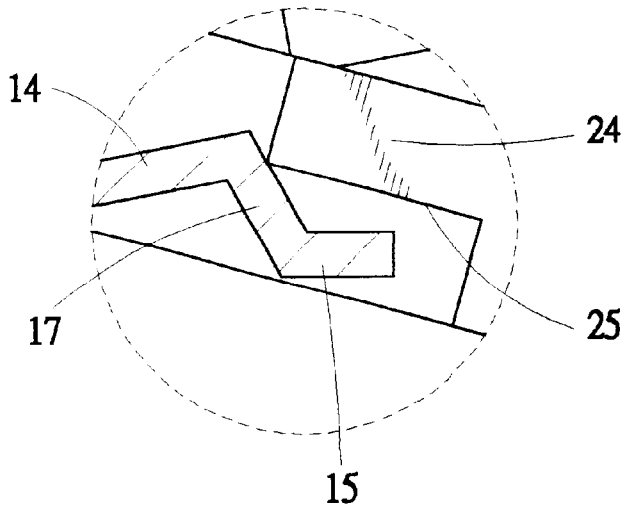
FIG. 3A is an enlarged view of encircled portion 3A of FIG. 3.
Figure 3:
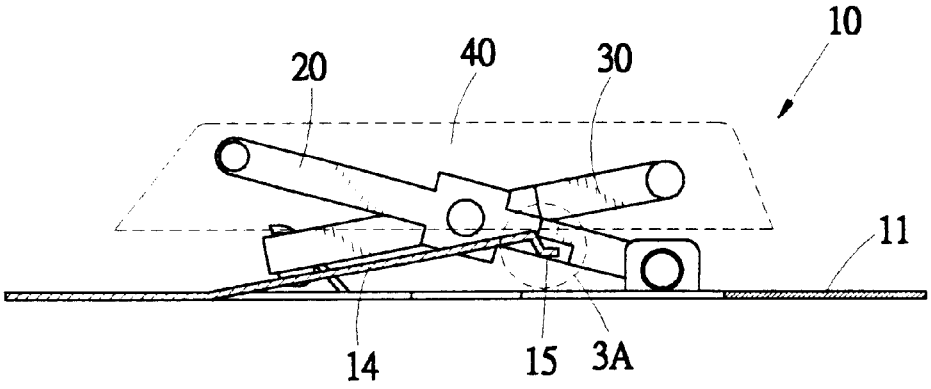
FIG. 3 is a side elevational view showing a linkage of the pushbutton of the present invention in a released condition.
Figure 4A:
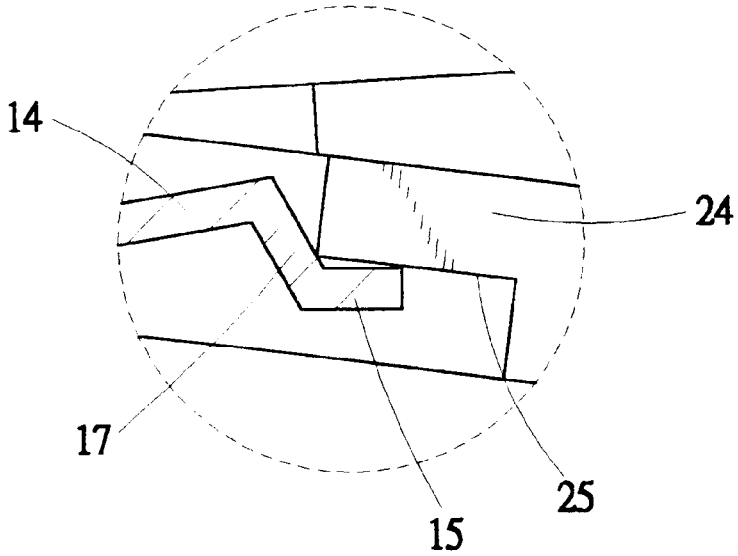
FIG. 4A is an enlarged view of encircled portion 4A of FIG. 4.
Figure 4:
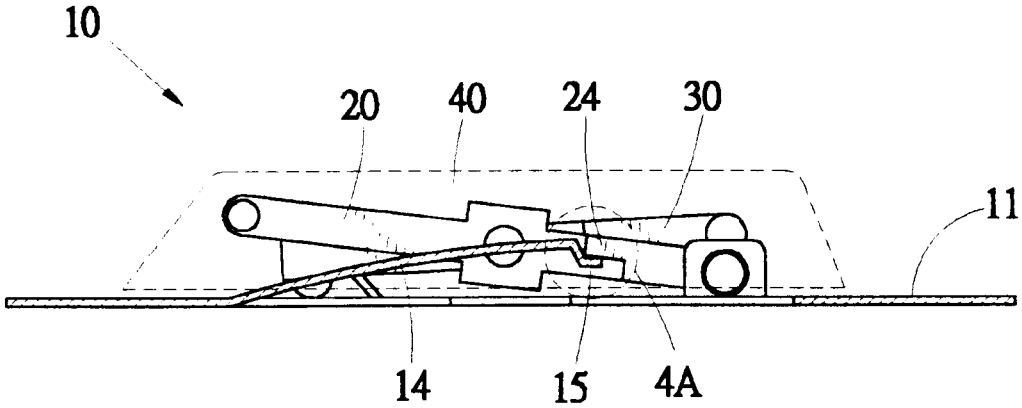
FIG. 4 is similar to FIG. 3 but showing the linkage of the pushbutton of the present invention in a depressed condition.

As shown in FIG. 3A, when the linkage is in the released position, an edge of the recess 24 engages a sloped portion (not label) which connects the offset section 15 to the spring arm 14 with the offset section 15 being spaced from the contact surface 25 of the recess 24. As shown in FIG. 4A, when the cap 40 is depressed to such an extent that the spring force of the spring arm 14 is greater than the friction between the recess 24 and the sloped portion 17 of the spring arm 14, the offset section 15 is abruptly moved toward and impacts the contact surface 25 of the recess 24. A sound is generated. A pulse-like reaction is also generated when the offset section 15 impacts the contact surface 25.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A pushbutton comprising:

a cap having an underside with first and second pivot retaining means formed thereon;

a base board forming two spaced tabs defining aligned holes and two spring arms each having an end forming an offset section with a connection formed between the offset section and the spring arm whereby an L-shaped configuration is formed, a slot being defined in the base board;

a U-shaped first link having a first pivot pin with two first side bars extending from opposite ends of the first pivot pin, the first pivot pin being rotatably received in and retained by the first pivot retaining means of the cap, free ends of the first side bars forming second pivot pins rotatably received in and retained by the holes of the tabs of the base board, the first side bars defining aligned holes, each first side bar having a recess formed therein, the recess having a contact surface formed thereon;

a second link in the form of a rectangular frame having third and fourth pivot pins connected to each other by two second side bars, the third pivot pin being rotatably received in and retained by the second pivot retaining means of the cap and the fourth pivot pin being rotatably received in and the retained by the slot of the base board, transverse pins extending from the second side bars and rotatably receive in the holes of the first side bars to form a cross configuration;

the offset section of each spring arm being adapted to engage a portion of the recess of the corresponding first side bar to support the linkage in an un-depressed position and the spring arm being deformed responsive to the cap being depressed, the offset section being abruptly displaced to impact the contact surface of the recess responsive to the spring arm being deformed to a predetermined extent to generate a sound of impact and a pulse-like reaction, the deformed spring arm biasing the first and second links to return the cap back to un-depressed position.

* * * * *